US011363931B2

(12) United States Patent
Manning et al.

(10) Patent No.: US 11,363,931 B2
(45) Date of Patent: Jun. 21, 2022

(54) SURFACE CLEANING APPARATUS

(71) Applicants: TTI (Macao Commercial Offshore Limited), Macau (CN); Daragh Manning, Birmingham (GB); Rafael Davila, Kannapolis (NC)

(72) Inventors: Daragh Manning, Birmingham (GB); Rafael Davila, Kannapolis (NC)

( * ) Notice: Subject to any disclaimer, the term of this patent is extended or adjusted under 35 U.S.C. 154(b) by 168 days.

(21) Appl. No.: 16/481,560

(22) PCT Filed: Jan. 29, 2018

(86) PCT No.: PCT/US2018/015707
§ 371 (c)(1),
(2) Date: Jul. 29, 2019

(87) PCT Pub. No.: WO2018/144380
PCT Pub. Date: Aug. 9, 2018

(65) Prior Publication Data

US 2019/0365182 A1 Dec. 5, 2019

(30) Foreign Application Priority Data

Jan. 31, 2017 (GB) ..... 1701567

(51) Int. Cl.
*A47L 11/20* (2006.01)
*A47L 11/34* (2006.01)
*A47L 11/40* (2006.01)

(52) U.S. Cl.
CPC ..... *A47L 11/201* (2013.01); *A47L 11/34* (2013.01); *A47L 11/4083* (2013.01); *A47L 11/4088* (2013.01)

(58) Field of Classification Search
CPC .... A47L 11/201; A47L 11/34; A47L 11/4083; A47L 11/4088; A47L 11/06;
(Continued)

(56) References Cited

U.S. PATENT DOCUMENTS 6,158,081 A * 12/2000 Kasen ..... A47L 5/28 15/320
6,438,797 B1 * 8/2002 Thomas ..... A47L 13/22 16/110.1
(Continued)

FOREIGN PATENT DOCUMENTS

WO 2005038318 A1 4/2005

OTHER PUBLICATIONS

United Kingdom Patent Office Search Report for Application No. 1701567.8, dated May 16, 2017, 1 page.
(Continued)

*Primary Examiner* — Monica S Carter
*Assistant Examiner* — Michael A Gump
(74) *Attorney, Agent, or Firm* — Michael Best & Friedrich LLP

(57) ABSTRACT

A surface cleaning apparatus including, a fluid storage container; an outlet for directing fluid from the fluid storage container onto a surface to be cleaned; and a valve configured to regulate the flow of fluid from the fluid storage container to the outlet and including: a body; and a member being moveable relative to the body between a first position and a second position and defining a flow path extending through a surface thereof; wherein the flow of fluid through the valve flows at a first rate when the member is in the first position and at a second rate and along the flow path when the member is in the second position, the second rate of flow being lower than the first rate of flow.

20 Claims, 4 Drawing Sheets

(58) Field of Classification Search
CPC .. A47L 11/4036; A47L 11/408; A47L 11/085; A47L 11/065; A47L 11/125; A47L 11/145; A47L 11/161; A47L 11/1625; A47L 11/185; A47L 11/30; A47L 11/03; A47L 11/4016; A47L 11/4013; A47L 11/40; A47L 13/22; A47L 7/0004; A47L 7/00; F16K 5/0605; F16K 5/10; F16K 3/26; F16K 3/262; F16K 3/246; F16K 3/267; F16K 11/0716
USPC ..... 15/320; 251/207
See application file for complete search history.

(56) References Cited

U.S. PATENT DOCUMENTS 8,448,293 B2 5/2013 Sepke
2005/0029971 A1* 2/2005 Coates ..... A47L 11/4088 318/400.38
2005/0081319 A1* 4/2005 Legatt ..... F16K 5/10 15/320
2005/0144751 A1 7/2005 Kegg et al.
2005/0283940 A1 12/2005 Hertrick et al.
2006/0272120 A1 12/2006 Barrick et al.
2007/0034267 A1* 2/2007 Partridge ..... F16K 5/0605 137/625.32
2007/0280775 A1* 12/2007 Schouten ..... A47L 13/22 401/281
2015/0327741 A1* 11/2015 Krebs ..... A47L 11/4088 15/322
2018/0168419 A1* 6/2018 Johnson ..... A47L 11/4094
2019/0128431 A1* 5/2019 Lee ..... F16K 5/0605

OTHER PUBLICATIONS

International Search Report and Written Opinion for Application No. PCT/US2018/015707, dated Apr. 20, 2018, 13 pages.

* cited by examiner

SURFACE CLEANING APPARATUS

CROSS-REFERENCE TO RELATED APPLICATIONS

This application claims priority to UK Patent Application No. 1701567.8, filed Jan. 31, 2017, the entire contents of which are hereby incorporated by reference herein.

BACKGROUND

This invention relates to a surface cleaning apparatus. More particularly, but not exclusively, this invention relates to a vacuum cleaner which is capable of washing carpets or other hard floor surfaces including a valve that is configurable to regulate the flow of fluid to the surface. Such cleaners are commonly referred to as wet vacuum cleaners.

The use of wet vacuum cleaners for cleaning floor surfaces is well known. Known wet vacuum cleaners typically have a floor head which is adapted to be moved over a surface to be cleaned. The floor head may carry a cleaning element such as a fabric/textile or other material which is able to absorb liquid. The floor head may alternatively or additionally be equipped with an agitator as is well known in the art to agitate the surface to remove dirt entrained therein. A fluid can be emitted from the cleaner onto the surface to be cleaned which can have the effect of loosening dirt from the surface. The fluid (which is typically a liquid) can be provided with additives to improve the cleaning effect. A suction inlet is typically used in combination with a source of suction to remove the dirty cleaning fluid from the surface.

SUMMARY

A problem associated with prior art cleaners is that there is no simple way of controlling the flow of fluid emitted from the cleaner to the surface.

Embodiments of this invention seek to overcome, or at least substantially reduce, this problem.

According to the present invention, we provide a surface cleaning apparatus including:

a fluid storage container;

an outlet for directing fluid from the fluid storage container onto a surface to be cleaned; and a valve configured to regulate the flow of fluid from the fluid storage container to the outlet and including:

a body; and a member being moveable relative to the body between a first position and a second position and defining a flow path extending through a surface thereof;

wherein the flow of fluid through the valve flows at a first rate when the member is in the first position and at a second rate and along the flow path when the member is in the second position, the second rate of flow being lower than the first rate of flow.

Further features of the invention are set out in the claims appended hereto.

Other aspects of the invention will become apparent by consideration of the detailed description and accompanying drawings.

BRIEF DESCRIPTION OF THE DRAWINGS

Embodiments of the invention will now be described by way of example only with reference to the accompanying figures, of which.

DETAILED DESCRIPTION

Figure 1:
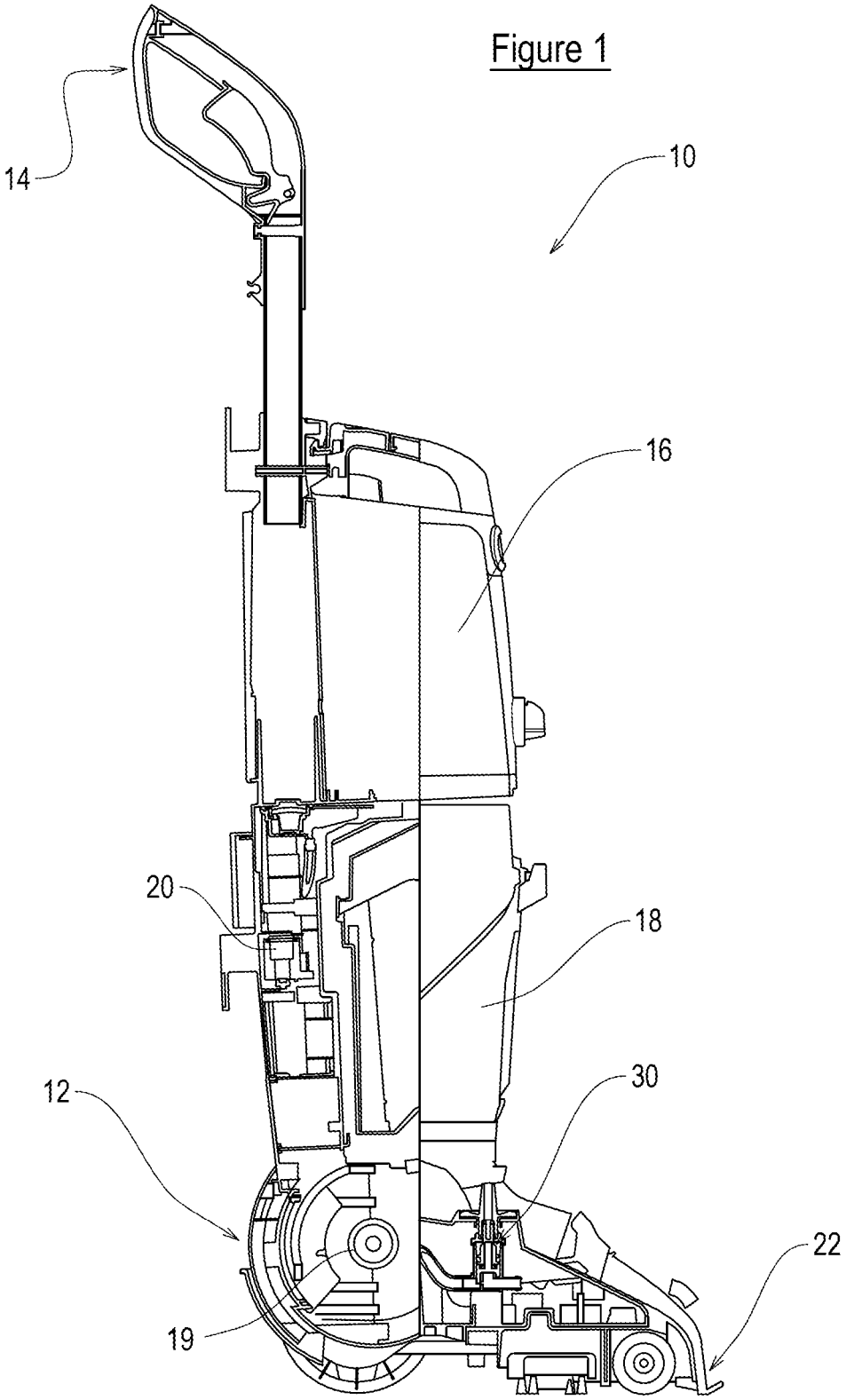
FIG. 1 is a cross-sectional view of a surface cleaning apparatus in accordance with the present invention.

Referring to FIG. 1 there is shown a surface cleaning apparatus 10 in accordance with the present invention. The apparatus 10 includes a floor head 12 which may be pivotably connected to a user graspable handle 14 and a fluid storage container 16 for holding a quantity of cleaning fluid to be dispensed onto a surface to be cleaned. The cleaning fluid is typically a liquid provided with cleaning additives. A fluid recovery container 18 and a source of suction 19 are provided, so that fluid that has been dispensed onto the surface to be cleaned may be removed by suction and stored. The fluid recovering container 18 may then be emptied after the apparatus 10 has been used. In other words, the apparatus 10 is a wet vacuum cleaner although it is to be appreciated that the vacuum cleaner may perform equally effectively as a dry vacuum cleaner.

In some embodiments a pump 20 may be provided that is configured to pump cleaning fluid from the fluid storage container 16 to an outlet 22 of the apparatus 10. The pump 20 may be user operable so that a user can control at what stage fluid is to be emitted from the outlet 22. The outlet 22 directs fluid from the fluid storage container 16 onto a surface to be cleaned.

In some embodiments, the pump 20 may be fluidly located between the fluid storage container 16 and a valve 30. By fluidly located it is meant that fluid passes from the fluid storage container 16 to the pump 20 and then to the valve 30. The components of the cleaner do not necessarily need to be positioned spatially in that order in the apparatus 10. All that is required is that fluid passes between those components in that order. The valve 30 is configured to regulate the flow of fluid from the fluid storage container 16 to the outlet 22. In some embodiments, the pump 20 may be fluidly located between the valve 30 and the outlet 22.

In some embodiments, the valve 30 may be located in the floor head 12. Alternatively, in some embodiments the valve 30 may be located elsewhere; for example, the valve 30 may be located in a main housing of the apparatus 10, or in or adjacent the fluid storage container 16 or pump 20.

The floor head 12 may be provided with a suction nozzle operatively connected to the source of suction and the fluid recovery container 18. A first fluid passage may be provided between the fluid storage container 16 and the pump 20. A second fluid passage may be provided between the pump 20 and the valve 30. A third fluid passage may be provided between the valve 30 and the outlet 22.

The apparatus 10 need not be provided with a pump 20 for pumping fluid from the fluid storage container 16 to the valve 30. For instance, in some embodiments fluid may be fed between the fluid storage container 16 and the valve 30 by gravity. In such embodiments, an on-off switch (not shown) may be provided between the fluid storage container 16 and the valve 30 to offer the user a way of stopping the flow of fluid to the valve 30.

Figure 2A:
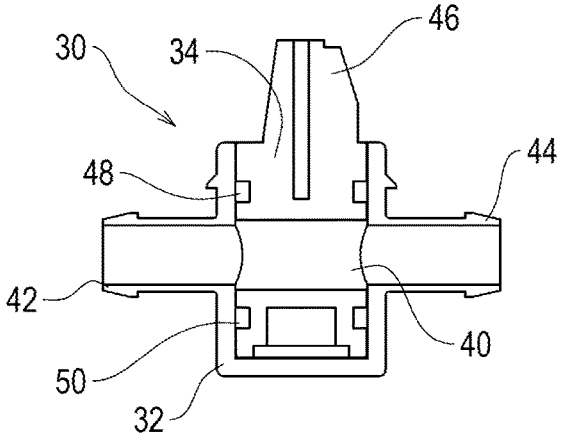
FIG. 2*a* is a cross-sectional view of a first embodiment of a valve, shown in a first configuration.
Figure 2B:
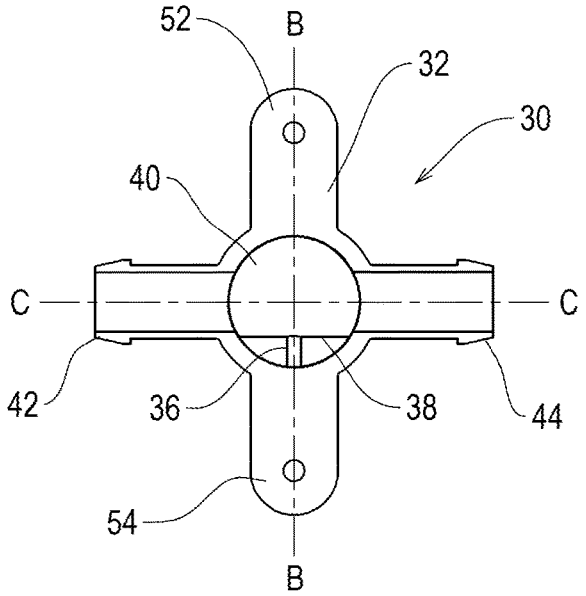
FIG. 2*b* is a cross-sectional and plan view of a first embodiment of a valve, shown in the first configuration.
Figure 3A:
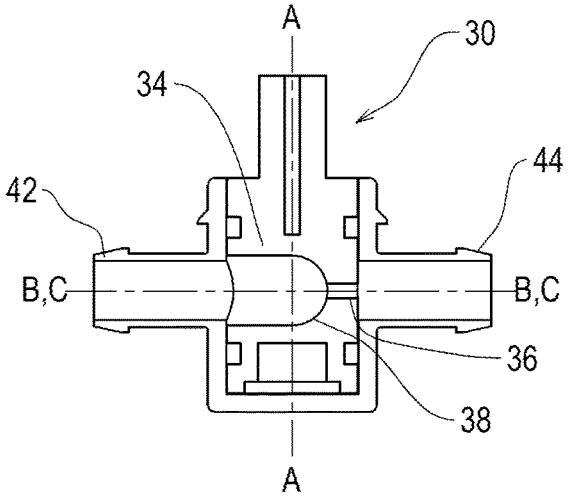
FIG. 3*a* is a cross-sectional view of the valve of FIGS. 2*a* and 2*b*, shown in a second configuration.
Figure 3B:
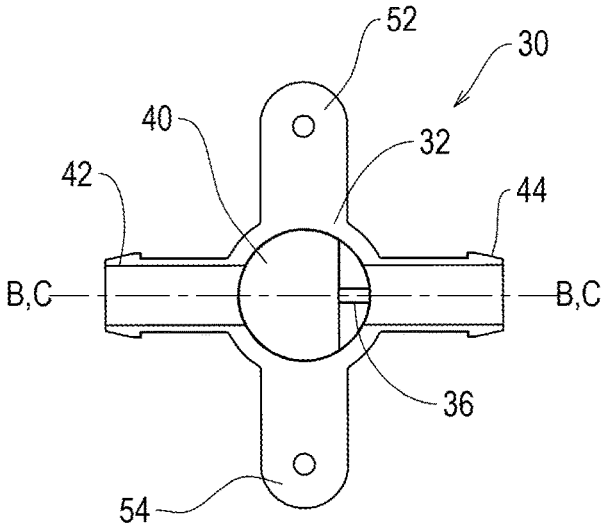
FIG. 3*b* is a cross-sectional and plan view of the valve of FIGS. 2*a* and 2*b*, shown in the second configuration.

Referring now to FIGS. 2 and 3, the valve 30 includes a body 32 and a member 34. The member 34 is moveable relative to the body 32 between a first position and a second position. The member 34 also defines a flow path 36 which extends through a surface 38 of the member 34. The flow of fluid through the valve 30 flows at a first rate when the member 34 is in the first position (FIGS. 2*a* and 2*b*) and at a second rate and along the flow path 36 when the member 34 is in the second position (FIGS. 3*a* and 3*b*). It is to be appreciated that the second rate of flow is lower than the first rate of flow.

This permits the apparatus 10 to have at least two cleaning modes: a first cleaning mode where the rate of fluid flow is higher than in a second mode. Having more than one cleaning mode is advantageous because it provides the user with selectivity. For instance, operating the apparatus 10 in the first cleaning mode has an advantage that a surface is thoroughly cleaned due to the high volume of cleaning fluid that is dispensed. Equally, operating the apparatus 10 in the second cleaning mode has an advantage that a greater surface area can be cleaned with the same volume of cleaning fluid, when compared to operation in the first cleaning mode. Operation in the second cleaning mode also provides for faster drying of a surface since less cleaning fluid will have been dispensed.

The body 32 may define an axis A about which the member 34 is rotatable between its first and second positions.

In some embodiments, the member 34 may define a cavity 40. The cavity 40 may be in fluid communication with the flow path 36. The flow path 36 may define a fluid flow path axis B along which fluid flows, the flow path axis B being substantially orthogonal to the axis A of the body 32.

In some embodiments, the cavity 40 may be generally elongate and extend in a direction along the axis A of the body 32.

In the valve 30 shown in FIGS. 2 and 3 the member 34 is configured to permit a continuous flow of fluid through the valve 30 as the member 34 moves between its first and second positions. In other words, the member 34 cannot adopt a position whereby flow of fluid through the valve 30 is stopped. This is particularly advantageous because it ensures that there can be no discontinuity in the supply of fluid to the outlet 22 as the member 34 moves between its first and second positions, thus mitigating the risk that the valve 30 might become damaged, e.g. due to excessive pressure building up between the pump and the valve 30, or from causing the second fluid passage to become disconnected from the pump or valve.

In some embodiments (not shown) a further flow path may be provided in the member 34. In such embodiments, the member 34 may be moveable relative to the body 32 between first, second and third positions. In those embodiments, the flow of fluid through the valve 30 flows at a first rate when the member 34 is in the first position; a second rate and along the flow path 36 when the member 34 is in the second position; and at a third rate and along the further flow path when the member is in the third position. The third rate of flow is lower than the second rate of flow and the first rate of flow. This provides a further third cleaning mode when the third rate of fluid flow is provided.

In some embodiments, the body 32 may include one or both of a valve inlet 42 and a valve outlet 44. The second fluid passage is connected to the valve inlet 42 and the third fluid passage is connected to the valve outlet 44. The valve inlet 42 and valve outlet 44 may be provided with spigots to permit the push fitting of the second and third fluid passages thereon. In some embodiments the outlet 22 is the valve outlet 42. In those embodiments only first and second fluid passages are provided.

In some embodiments, a further valve outlet (not shown) may be provided with a further fluid passage to a further outlet (not shown). In these embodiments the flow path 36 may permit the flow of fluid through both the valve outlet 44 and the further valve outlet.

In the embodiments shown in FIGS. 2 and 3 the flow path 36 of the member 34 is positioned adjacent the valve outlet 44 when the member 34 is in the second position. In alternative embodiments the flow path 36 of the member 34 may be positioned adjacent the valve inlet 42 when the member 34 is in the second position. However, it should be appreciated that all that is required is that a first flow rate and a second flow rate are provided where the second flow rate is less than the first flow rate. The flow path 36 advantageously has a smaller cross-sectional area than that of the valve inlet 42, or valve outlet 44. It is to be appreciated, therefore, that the flow path 36 causes a restriction on the flow of fluid through the valve 30 when the member is in the second position.

The valve 30 is provided with a user control 46 in the form of a dial which is operatively associated with the member 34 so that a user can move the member 34 between its first and second positions upon actuation of the user control 46. It should be appreciated that other forms of user control, such as a lever, could be used without departing from the scope of the present invention.

In this particular embodiment, the valve inlet 42 and the valve outlet 44 are diametrically opposed. This is advantageous as it ensures a smooth, laminar flow of fluid through the valve 30 in the first position at least. The valve inlet 42 and the valve outlet 44 define a valve axis C. The flow path axis B is substantially orthogonal to the valve axis C when the member 34 is in the first position and the flow path axis B is substantially parallel to the valve axis C when the member 34 is in the second position. Alternatively or additionally, the valve inlet 42 and the valve outlet 44 may be spaced apart from one another along the axis A or another axis of the body 32. This may, advantageously, permit the valve 30 to be mounted in a more compact configuration in the apparatus 16, and may also make replacement of the valve 30 easier.

The body 32 and the member 34 may each have a generally circular cross-sectional area and be arranged generally concentrically with each other. Alternatively, the body 32 may be provided with a different cross-sectional area, such as rectangular, without departing from the scope of the present invention. The member 34 may also be provided with O-rings 48, 50 to produce a fluid tight seal between the member 34 and the body 32. The valve 30 may also be provided with brackets 52, 54 to permit the valve 30 to be mounted onto the apparatus 10.

In the valve shown in FIGS. 2 and 3 the member 34 is rotatably moveable relative to the body 32 about the axis A. In particular, the member 34 may be rotatably moveable through about 90 degrees from the first position to the second position, although the range of motion may be greater than or less than 90 degrees without departing from the scope of the invention.

The member 34 may be biased, preferably resiliently biased, towards the first position by a biasing device, e.g. a torsion spring. Alternatively, the member 34 may be biased, preferably resiliently, towards the second position. The surface cleaning apparatus 10 may also be provided with a locking device (not shown) configurable to lock the member 34 in one or both of the first and second positions.

Figure 4:
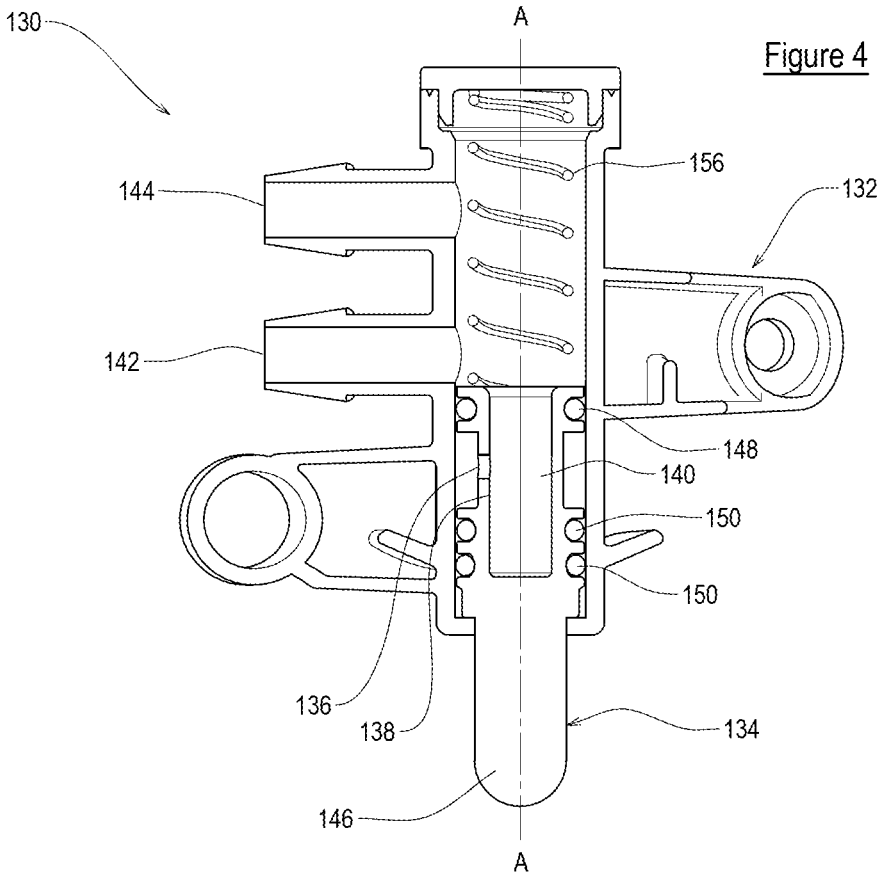
FIG. 4 is a cross-sectional view of a second embodiment of a valve, shown in a first configuration.
Figure 5:
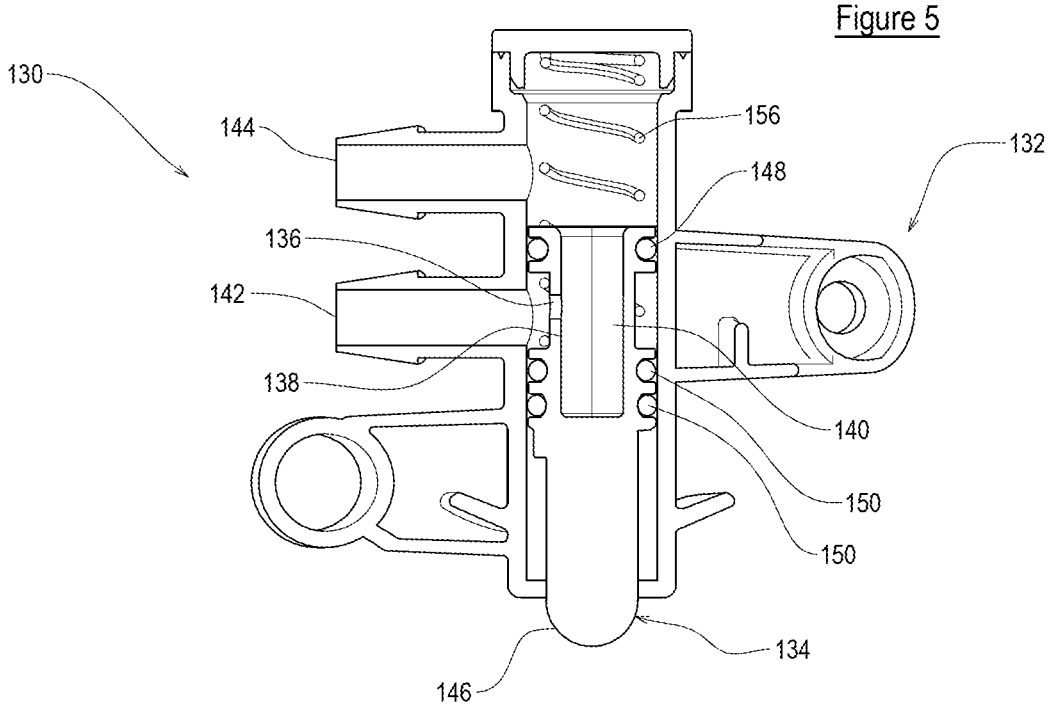
FIG. 5 is a cross-sectional view of the valve of FIG. 4, shown in a second configuration.

FIGS. 4 and 5 show an alternative valve 130 embodiment. Features in common with the embodiment shown in FIGS. 2 and 3 have been given the same reference numeral but with the addition of 100.

It is to be appreciated that either valve 30, 130 could be utilised in the apparatus 10 of FIG. 1.

The alternative valve embodiment has all the features of the first embodiment with the exception of the following.

The member 134 includes a cavity 140 which is generally elongate and extends in a direction along an axis A of the body 132.

The valve inlet 142 and the valve outlet 144 of the valve 130 are spaced apart from one another along the axis A, rather than being un-spaced along the axis A.

The valve inlet 142 and the valve outlet 144 are provided on the same side of the body 132, rather than being diametrically opposed.

The member 134 is axially moveable along the axis A, rather than being rotatably moveable about axis A.

It is to be appreciated that in some embodiments (not shown) the member 134 may be axially moveable along and rotatably moveable about axis A.

The flow path 136 of the member 134 is adjacent the valve inlet 142 when the member 136 is in the second position.

In this second embodiment the member 134 is biased, preferably resiliently biased, towards the first position by a biasing device 156, e.g. a coil spring.

In the present embodiment the surface cleaning apparatus 10 is a wet/dry style upright vacuum cleaner. However, it should be appreciated that the apparatus 10 could take the form of a cylinder vacuum cleaner, a stick type vacuum cleaner, a spot cleaner or a hand held vacuum cleaner. It is also to be appreciated that the apparatus 10 may alternatively be provided as a mop type cleaner.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A surface cleaning apparatus comprising:

a fluid storage container;

an outlet for directing fluid from the fluid storage container onto a surface to be cleaned; and a valve configured to regulate the flow of the fluid from the fluid storage container to the outlet and the valve including, a body including a valve inlet and a valve outlet;

a member being moveable relative to the body between a first position and a second position and defining a flow path extending through the member into a cavity defined within the member, wherein the body defines an axis along which the member is axially moveable in the direction of the axis;

a first seal positioned around the member and positioned axially above the flow path; and a second seal positioned around the member and positioned axially below the flow path, wherein each of the first seal and second seal produces a fluid tight seal between the member and the body;

wherein the flow of the fluid through the valve flows at a first rate when the member is in the first position and at a second rate and along the flow path when the member is in the second position, the second rate of flow being lower than the first rate of flow;

wherein when the member is in the second position, the first seal is positioned axially between the valve inlet and valve outlet; and wherein when the member is in the first position, the first seal and the member are located axially below the valve inlet and valve outlet.

2. The surface cleaning apparatus according to claim 1 wherein the cavity is in fluid communication with the flow path.

3. The surface cleaning apparatus according to claim 1 wherein the flow path defines a flow path axis along which the fluid flows, the flow path axis being substantially orthogonal to a longitudinal axis of the body.

4. The surface cleaning apparatus according to claim 1 wherein the cavity is generally elongate and extends in a direction along a longitudinal axis of the body.

5. The surface cleaning apparatus according to claim 1 wherein the member is configured to permit a continuous flow of fluid through the valve as the member moves between the first and second positions.

6. The surface cleaning apparatus according to claim 1 wherein the valve outlet is the outlet.

7. The surface cleaning apparatus according to claim 1 wherein the valve inlet and the valve outlet are spaced apart from one another along a longitudinal axis of the body.

8. The surface cleaning apparatus according to claim 1 wherein the flow path of the member is positioned adjacent the valve outlet when the member is in the second position.

9. The surface cleaning apparatus according to claim 1 wherein the flow path of the member is positioned adjacent the valve inlet when the member is in the second position.

10. The surface cleaning apparatus according to claim 1 wherein a user control is operatively associated with the member so that a user can move the member between the first and second positions upon actuation of the user control.

11. The surface cleaning apparatus according to claim 10 wherein the user actuated control moves axially with the member.

12. The surface cleaning apparatus according to claim 1 wherein the member is biased towards the first position.

13. The surface cleaning apparatus according to claim 12 wherein the member is resiliently biased towards the first position.

14. The surface cleaning apparatus according to claim 12 wherein the member is biased toward the first position by a coil spring positioned in the body.

15. The surface cleaning apparatus according to claim 1 including a pump configured to pump the fluid from the fluid storage container to the outlet.

16. The surface cleaning apparatus according to claim 15 wherein the pump is fluidly located between the fluid storage container and the valve.

17. The surface cleaning apparatus according to claim 1 wherein the apparatus includes a floor head and wherein the valve is located in the floor head.

18. The surface cleaning apparatus according to claim 1 including a source of suction.

19. The surface cleaning apparatus according to claim 1 wherein the flow path is defined by an opening extending through the member and the opening is positioned in a groove circumscribing the member.

20. A surface cleaning apparatus comprising:

a fluid storage container;

an outlet for directing fluid from the fluid storage container onto a surface to be cleaned; and a valve configured to regulate the flow of the fluid from the fluid storage container to the outlet and the valve including, a body; and a member being moveable relative to the body between a first position and a second position and defining a flow path extending through the member into a cavity defined within the member, wherein the body defines an axis along which the member is axially moveable in the direction of the axis;

wherein the flow of the fluid through the valve flows at a first rate when the member is in the first position and at a second rate and along the flow path when the member is in the second position, the second rate of flow being lower than the first rate of flow;

wherein the flow path is defined by an opening extending through the member and the opening is positioned in a groove circumscribing the member.

* * * * *